US008253024B2

(12) United States Patent
Belton et al.

(10) Patent No.: US 8,253,024 B2
(45) Date of Patent: Aug. 28, 2012

(54) METHOD AND APPARATUS FOR COOLING SUPERCONDUCTIVE JOINTS

(75) Inventors: Neil John Belton, Oxon (GB); Simon James Calvert, Oxon (GB); Raymond Hornsby, Oxford (GB); Marcel Jan Márie Kruip, Oxford (GB)

(73) Assignee: Siemens PLC, Frimley, Camberley (GB)

( * ) Notice: Subject to any disclaimer, the term of this patent is extended or adjusted under 35 U.S.C. 154(b) by 968 days.

(21) Appl. No.: 12/252,484

(22) Filed: Oct. 16, 2008

(65) Prior Publication Data

US 2009/0101325 A1 Apr. 23, 2009

(30) Foreign Application Priority Data

Oct. 16, 2007 (GB) ..... 0720166.8

(51) Int. Cl.
*H01B 12/00* (2006.01)

(52) U.S. Cl. ..... 174/125.1; 174/15.4; 174/15.5; 174/17 S; 174/17 F; 505/230; 505/231; 505/232; 505/430; 505/431

(58) Field of Classification Search ..... 174/15, 174/4, 15.5, 17 S, 17 F; 505/230–232, 430–432
See application file for complete search history.

(56) References Cited

U.S. PATENT DOCUMENTS

| | | | | |
|---|---|---|---|---|
| 4,631,808 | A | 12/1986 | Jones | |
| 5,502,288 | A * | 3/1996 | Cogen et al. | 174/113 R |
| 5,613,367 | A * | 3/1997 | Chen | 62/47.1 |
| 7,273,569 | B2 * | 9/2007 | Walter et al. | 252/500 |
| 7,531,750 | B2 * | 5/2009 | Kellers et al. | 174/125.1 |

* cited by examiner

*Primary Examiner* — Yuriy Semenenko
*Assistant Examiner* — Andargie M Aychillhum
(74) *Attorney, Agent, or Firm* — Schiff Hardin LLP

(57) ABSTRACT

In a method and apparatus for joining a number of superconductive cables to establish electrical connection therebetween, a cup-like member having a base, a sidewall, and an opening to receive electrically conductive ends of said cables is provided. The base of the cup-like member is attached to a holder device. The holder device is attached to a cryogenically cooled surface. The ends of the superconductive cables are connected together within the cup-like member.

15 Claims, 3 Drawing Sheets

METHOD AND APPARATUS FOR COOLING SUPERCONDUCTIVE JOINTS

BACKGROUND OF THE INVENTION

1. Field of the Invention

The present invention relates to methods of cooling joints between superconductive cables such as used, for example, in magnets for magnetic resonance imaging (MRI) systems.

2. Description of the Prior Art

Joints of the above type are typically made by exposing the superconductive filaments within a superconducting cable, cleaning the filaments then braiding them together and infusing them with a superconductive alloy such as a Lead-Bismuth alloy PbBi. Typically, the joint is placed in a metallic cup which is filled with the PbBi alloy, to form the superconducting joint. Such action may be termed "potting" the joint. For such joints to remain superconducting, they must remain cooled to below the critical temperature of the filaments and the jointing alloy PbBi.

When used with conventional, bath-cooled magnet systems, maintenance of the required low operational temperature is straightforward, since the joints are immersed in boiling liquid helium and thus maintained at about 4·2 Kelvin. However, in other systems where the magnets are cooled by conduction, it is significantly more difficult to ensure that the joints do not assume temperatures higher than the critical temperature of the superconducting cables, as the joints cannot be immersed in a liquid helium bath or contained within a cold helium gas atmosphere. Furthermore, the joints are subjected to extremely high electrical voltages to ground, in the order of 5 kV, during quench events. It is accordingly necessary to provide an arrangement which will enable effective conduction cooling of the joints, yet provide adequate voltage isolation of the joints from other parts of the system.

SUMMARY OF THE INVENTION

An object of the present invention to address the aforementioned difficulties and accordingly in a method and an apparatus for cooling superconductive joints.

The above object is achieved in accordance with the present invention by a method and an arrangement for cooling a superconductive joint while providing voltage isolation thereof, wherein a receptacle is provided to receive the joint, and the receptacle is attached to a cooled surface with an electrically isolating layer interposed therebetween, and the joint is embedded in a jointing material within the receptacle.

DESCRIPTION OF THE PREFERRED EMBODIMENTS

Figure 1:
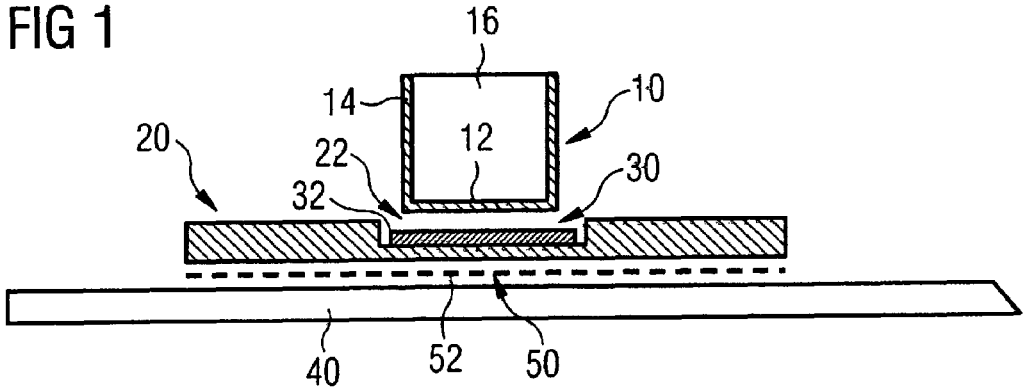
FIG. 1 shows, in an exploded cross-section, components of a joint cooling assembly produced by a method according to one embodiment of the invention.

FIG. 1 shows an example embodiment of the present invention. In this embodiment, the superconducting joint is formed and housed within a receptacle 10, which in this embodiment is a cup-like receptacle 10 formed of thermally conductive material, for example brass or copper. The cup-like receptacle has a base 12, a sidewall 14, and an opening 16.

Such cup-like receptacles are known and are used to accommodate superconducting joints in conventional, bath-cooled magnet systems. In such arrangements, maintenance of the required low operational temperature is straightforward, since the joints are immersed in boiling liquid helium and thus maintained at about 4·2 Kelvin. However, in other systems where the magnets are cooled by conduction, it is significantly more difficult to ensure that the joints do not assume temperatures higher than the critical temperature of the superconducting cables. Furthermore, the joints are subjected to extremely high electrical voltages to ground, in the order of 5 kV, during quench events. It is accordingly necessary to provide an arrangement which will enable conduction cooling of the joints, yet provide adequate voltage isolation of the joints from other parts of the system. It will thus be appreciated that, with a conduction-cooled magnet system, it is necessary to take appropriate steps to ensure that joints are well cooled (i.e. they are maintained below 6 Kelvin and preferably nearer 4 Kelvin) and robustly insulated against electrical breakdown at high voltages.

Accordingly, this embodiment of the invention utilises a cup-like receptacle 10, made of a thermally conductive material such as brass or copper, and whose base 12 is attached to a cooled surface 20 by interposition of an electrically isolating layer 30. In order to provide the required cooling and electrical isolation, the material of electrically isolating layer 30 is chosen to exhibit desired degrees of thermal conductance and electrical impedance. It may be preferable to provide a well 22 in the cooled surface, to accommodate the material of the electrically isolating layer 30. The cooled surface 20 may be in the form of a holder device, made of a thermally conductive material such as aluminium. In such an embodiment, the cup-like receptacle 10 is attached to the holder device by interposition of the electrically isolating layer 30, and the holder device is then attached to a cooling means 40, such as a cryogenically cooled magnet. The joint is thereby maintained in operation at a temperature below the critical temperature of the superconducting cables, such as 6 Kelvin or less. The superconducting joint may be made and potted into the cup-like receptacle 10 either before or after it is attached to the cooled surface 20.

In one embodiment, holder device 20 is attached to the cooling means 40 by any suitable mechanical fixing means, such as one or more of the following: screw(s), bolt(s), rivet (s), clip(s) or clamp(s). Further, a medium 52 capable of enhancing thermal contact across the thermal interface 50 between the holder device 20 and the cooling means 40, is applied therebetween. The medium 52 conveniently comprises a layer of a hydrocarbon grease. Suitable greases are available commercially from Apiezon Products, M&I Materials Ltd, Hibernia Way, Trafford Park, GB-Manchester M32 0ZD, under the Registered Trade Mark "APEZION" (see www.apiezon.com/greasetable). This grease is produced by molecular distillation and exhibits, among other attributes, good thermal stability.

In a particular embodiment, the electrically isolating layer 30 is formed of a resinous adhesive 32; suitably that known commercially as "Stycast Resin 2850FT", with a "Type 9" catalyst both available from Emerson & Cuming, 46 Manning Road, Billerica, Mass. 01821 USA. "Stycast Resin 2850FT", utilised with a "Type 9" catalyst has a thermal conductivity of 1.25 W/mK and a dielectric strength of 14.4 kV/mm, which are considered suitable values of thermal conductivity and dielectric strength for use as the electrically isolating layer 30 in the present invention. In a typical installation, all component areas which are to be bonded should have their surfaces prepared to a required regime, e.g. by bead blasting, prior to final cleaning.

The electrically isolating layer 30 preferably provides bonding between the base 12 of the cup-like receptacle 10 and the cooled surface 20. In other embodiments, a separate electrically isolating layer may be provided, bonded to the receptacle 10 and the cooled surface 20 by other means. In a typical installation, a desired degree of electrical isolation between the cup-like receptacle 10 and the cooled surface 20 is assured by utilising a sufficient amount of the adhesive 32 to establish a predetermined thickness of the electrically isolating layer 30. A typical requirement for electrical insulation is to isolate a potential difference of at least 5 kV between the cup-like receptacle 10 and the cooled surface 20.

Figure 2:
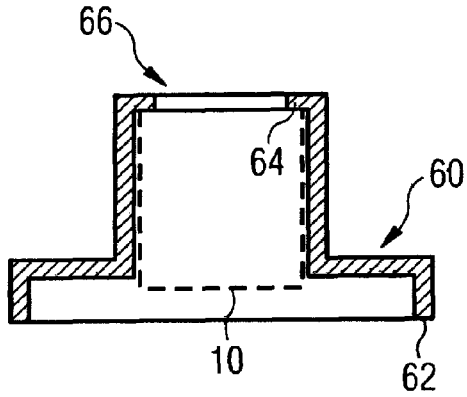
FIG. 2 shows, again in side elevation, an intermediate stage in setting up some of the components of FIG. 1.
Figure 3:
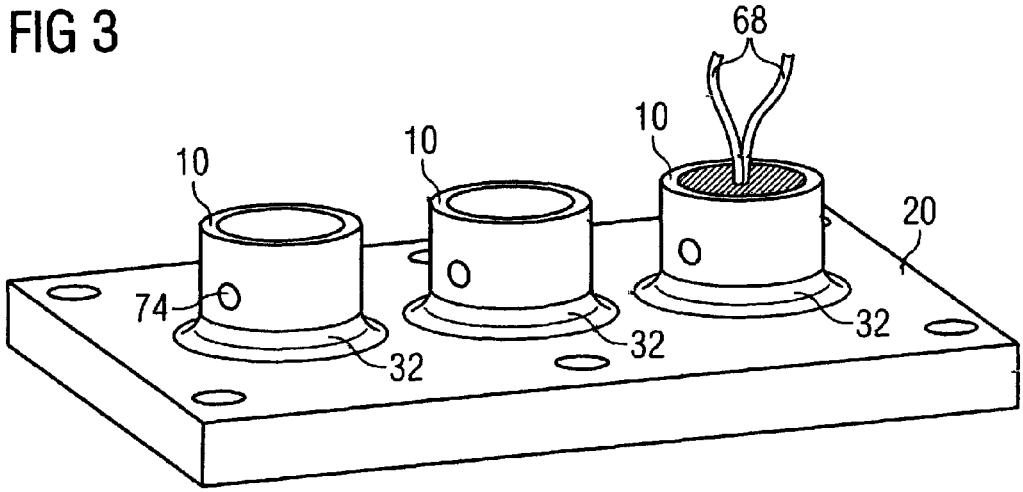
FIG. 3 shows, in perspective, a joint cooling assembly produced by a method according to an embodiment of the invention as illustrated in FIG. 1.

FIG. 2 illustrates a certain arrangement for ensuring that the electrically isolating layer 30 is provided to the desired thickness. A method, according to one embodiment of the invention, for assembling a structure as illustrated in FIGS. 1 and 3, will now be described with reference to FIG. 2. A required amount of adhesive 32, in this case Stycast resin 2850FT and Catalyst 9, to give an electrically isolating layer 30 of a desired thickness is prepared and the cuplike receptacle 10 is positioned into a gap-setting fixture 60, any holes in the receptacle 10 may be temporarily blocked if desired, using modeling clay or some other convenient agency. The gap-setting fixture 60 may be made of polytetrafluoroethylene PTFE. It is preferably generally top-hat shaped, and dimensioned such that the cup-like receptacle 10 is retained by an interference fit at a predetermined height above a lower edge 62 of the fixture. An upper lip 64 may be provided, and the receptacle 10 retained in abutting relation to said lip. The upper surface 66 of the fixture may be substantially open, as illustrated.

The required amount of adhesive 32 is placed on the cooled surface 20, in the well 22 if provided. The gap-setting fixture 60 carrying the receptacle 10 is then placed over the adhesive, such that the receptacle 10 is held at a predetermined height above the cooled surface 20, thereby defining an electrically isolating layer 30 of thickness equal to the predetermined height. Any excess adhesive 32 is removed at this stage, and the adhesive 30 is allowed to set and dry. Typically this setting and drying stage takes 8 to 10 hours. Alternatively, the receptacle 10 may be adjustably positionable within the gap-setting fixture 60 to enable electrically isolating layers 30 of differing thicknesses to be provided.

Next, the gap-setting fixture 60 is removed from the receptacle 10, which is now firmly bonded to the cooled surface 20.

In embodiments where the cooled surface 20 is a holder device the holder device 20 is then attached, for example by screws, to the cooling means 40, which may be a cryogenically cooled surface; a layer 52 of hydrocarbon grease being preferably provided at the thermal interface 50 between the holder device 20 and the cooling means 40 for the purposes described above.

FIG. 3 illustrates a completed structure, having three cup-like receptacles 10 bonded to a holder device 20 by an adhesive 32. One receptacle is shown housing a joint comprising a plurality of superconducting cables 68 joined together and embedded within a jointing material 70 such as PbBi alloy.

Figure 4:
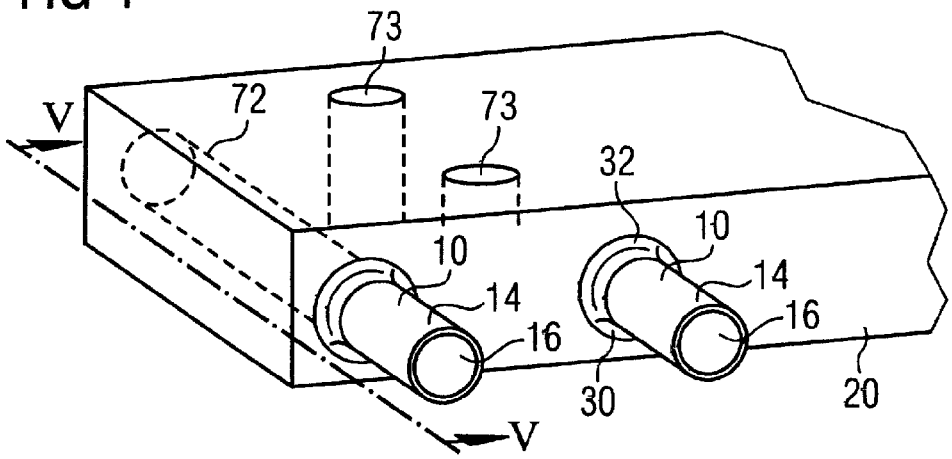
FIG. 4 shows, in perspective, a joint cooling assembly produced by a method according to another embodiment of the invention.

FIG. 4 shows another embodiment of the present invention.

Figure 5:
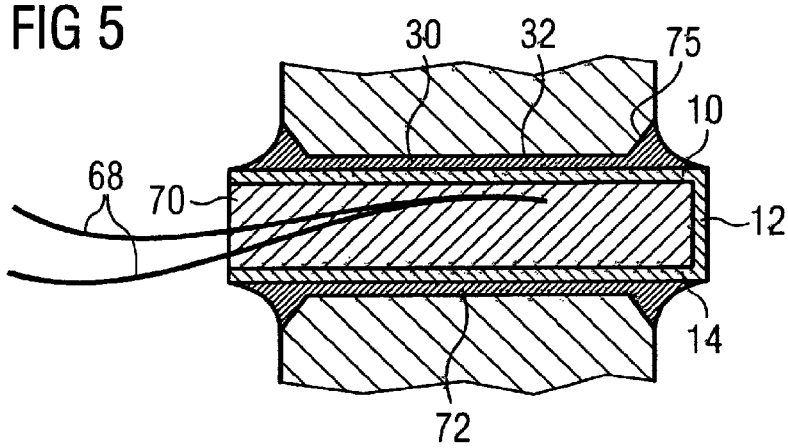
FIG. 5 shows a cross-section through part of the joint cooling assembly shown in FIG. 4, along the line V-V.

FIG. 5 shows a partial section through the structure of FIG. 4, along the line V-V.

Features common with the embodiment of FIGS. 1 and 3 carry corresponding reference labels. In the embodiment of FIG. 4, the receptacles 10 are of tubular form, having sidewall 14 and opening 16. The tubular receptacle may have a base 12, although this could be absent. As with the embodiment of FIGS. 1 and 3, the superconducting joint between superconducting cables 68 is potted in a jointing material 70 such as PbBi alloy within the receptacle. The cooled surface 20 comprises a cylindrical cavity 72, into which the tubular receptacle 10 is introduced. Again, an electrically isolating layer 30 is provided between the receptacle 10 and the cooled surface 20, to provide the required degree of electrical isolation while maintaining sufficient thermal conductivity. In such embodiments, the thickness of the electrically isolating layer 30 is defined by the difference between the outer diameter of the tubular receptacle 10 and the inner diameter of the cylindrical cavity 72. During assembly, a required quantity of adhesive 32 is introduced between the outer surface of the tubular receptacle 10 and the inner surface of the cylindrical cavity 72, and the receptacle 10 is held concentrically within the cavity 72 by any appropriate conventional method, such as by wrapping a spacer material, such as glassfibre cloth, around the receptacle or using a mechanical fixture. Such operation may be easier to achieve if the superconductive joints are potted into the receptacle 10 after the electrically isolating layer 30 is formed. Such embodiments may offer improved thermal performance as the electrical isolating layer 30 may have a larger surface area. Through holes 73 may be provided to enable screws or the like to pass therethrough, in order to mechanically retain the holder device 20 in thermal contact with a cooling means 40. As more clearly illustrated in FIG. 5, the cylindrical cavity 72 may be provided with chamfered ends 75. In the absence of such a chamfer, a right-angled corner would be present at the ends of the cavity 72. This would result in an intense peak in electric field intensity at the corner. With a voltage of up to 5 kV between the receptacle 10 and the holder device 20, there is a risk of electrical breakdown through the material of the electrically isolating layer 30, or across the surface of the electrical isolating layer, between the receptacle 10 and the holder device 20. By providing chamfered ends, the right-angled corner is removed, which reduces the peak electric field strength. The thickness of the electrical isolating layer at the ends of the cavity 72 is increased. Both of these effects reduce the risk of electrical breakdown through the material of the electrical isolating layer 30, or across the surface of the electrical isolating layer, between the receptacle 10 and the holder device 20.

Figure 6:
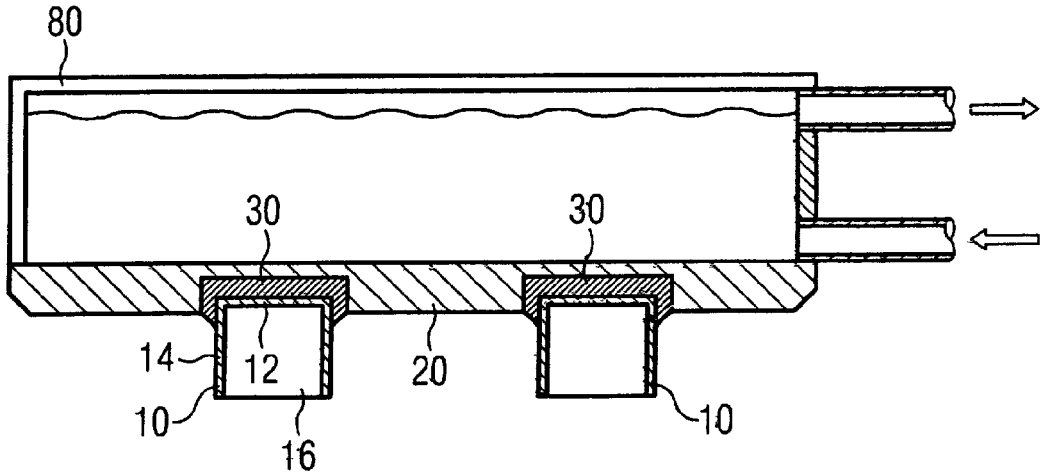
FIG. 6 shows, in cross-section, a joint produced by a method according to another embodiment of the invention.

FIG. 6 shows an example of a further series of embodiments, in which the cooled surface 20 is not a holder device, but is an integral part of the cooling arrangement. In the particular example shown in FIG. 6, the cooled surface 20 is part of a liquid cryogen vessel 80. The cup-like receptacles 10 of this particular embodiment are bonded to the wall of the cryogen vessel 80 by an electrically isolating layer 30. Similar embodiments using receptacles and cavities as illustrated in FIGS. 4 and 5 may also be provided, wherein cavities are provided in integral parts of the cooling arrangement, for example, walls of liquid cryogen vessels, magnet formers and the like. Such embodiments offer improved thermal performance, as the thermal impedance represented by the thermal interface 50 of the embodiments of FIGS. 1 and 3 is avoided.

Figure 7:
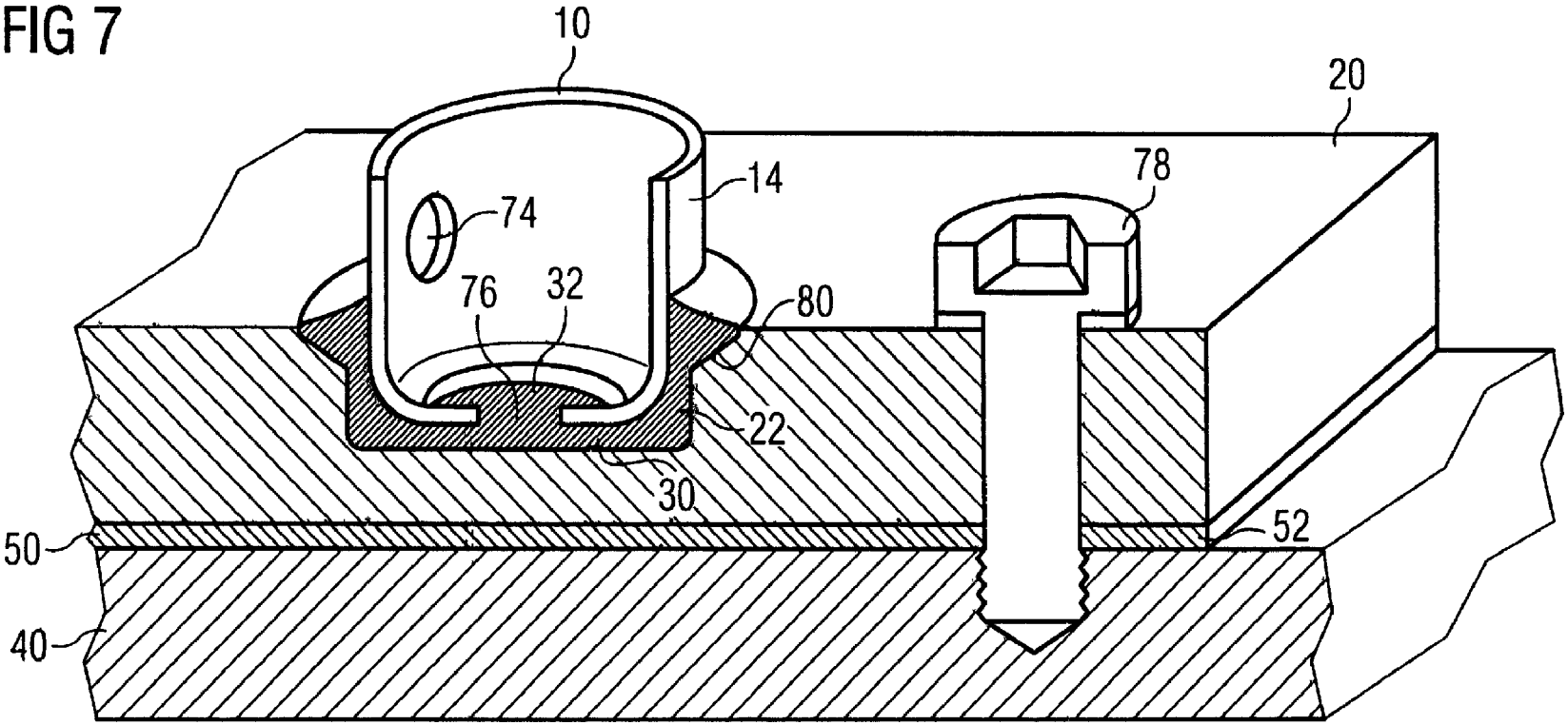
FIG. 7 shows a detailed out-away view of a joint cooling assembly according to a preferred embodiment of the present invention.

FIG. 7 shows a detailed cutaway view of a certain preferred embodiment of the present invention. Features corresponding to features of other drawings carry corresponding reference numerals. In the illustrated embodiment, cup-like receptacle 10 is placed in a well 22 formed in the surface of a holder device 20, which is preferably of aluminium or copper. Other thermally conductive materials may be used if desired. The receptacle 10 is typically of brass or copper but, again, other thermally conductive materials may be used if desired. In arrangements such as shown in FIG. 7, the thermal conductivity of the receptacle may be less important if the joint and its jointing material are in thermal contact with the electrically isolating layer 30. The well 22 may be formed with a chamfered upper edge 80. In the absence of such a chamfer, a right-angled corner would be present at the upper edge of the well 22. This would result in an intense peak in electric field intensity at the corner. With a voltage of up to 5 kV between the receptacle 10 and the cooled surface 20, there is a risk of electrical breakdown through the material of the electrically isolating layer 30, or across the surface of the electrical isolating layer, between the receptacle 10 and the cooled surface 20. By providing chamfered ends, the right-angled corner is removed, which reduces the peak electric field strength. The thickness of the electrical isolating layer at the upper edge of the well 22 is increased. Both of these effects reduce the risk of electrical breakdown through the material of the electrical isolating layer 30, or across the surface of the electrical isolating layer, between the receptacle 10 and the holder device 20. As illustrated, the receptacle 10 may include one or more holes 74 in its sidewall 14. In particular, the receptacle may include a hole 76 in its base. It may be preferred to allow some adhesive 32 to penetrate through the hole 76 in the base 12 of the receptacle 10. This may assist in the mechanical retention of the receptacle, and improve the thermal path from the receptacle 10 to the cooled surface 20. If such an arrangement is chosen, the superconducting joint should preferably be potted into the receptacle 10 after it has been bonded to the cooled surface. As illustrated, the cooled surface 20 is a holder device, which is attached to a cooling means 40 by a thermal interface 50. In a preferred embodiment, the thermal interface is improved by the interposition of a layer of "APEZION"® grease 52 between the holder device 20 and the cooling means 40, as described above. Mechanical connection of the holder device to the cooling means is provided by a through bolt 78 screwed into a threaded hole in the cooling means.

Although modifications and changes may be suggested by those skilled in the art, it is the intention of the inventor to embody within the patent warranted hereon all changes and modifications as reasonably and properly come within the scope of his contribution to the art.

We claim as our invention:

1. An arrangement for cooling a superconductive joint while providing voltage isolation thereof, comprising a receptacle that surrounds respective portions of two superconductors that form a superconductive joint also surrounded by said receptacle, a jointing material in which said joint is embedded within said receptacle; a cooled surface that superconductively cools said joint embedded in said joining material, and an electrically isolating layer adjacent said surface of said receptacle and interposed between said surface of said receptacle and said cooled surface.

2. An arrangement according to claim 1 wherein the receptacle is of cup-like form, having a base, a sidewall and an opening to receive said joint, and wherein said receptacle is attached to said cooled surface by said base.

3. An arrangement according to claim 1 wherein the receptacle is of tubular form, having a sidewall and an opening to receive said joint, and wherein said receptacle is attached to said cooled surface by said sidewall.

4. An arrangement according to claim 3 wherein said cooled surface comprises a cylindrical cavity, wherein the tubular receptacle is located, said electrically isolating layer being interposed between the sidewall of the tubular receptacle and a wall of the cylindrical cavity.

5. An arrangement according to claim 1, wherein the receptacle is attached to said cooled surface by an adhesive, said adhesive forming said electrically isolating layer.

6. An arrangement according to claim 5, wherein said electrically isolating layer is provided to a predetermined thickness.

7. An arrangement according to claim 1, wherein the receptacle is attached to a holder device by interposition of an electrically isolating layer; and said holder device is attached to a cooling means.

8. An arrangement according to claims 7, wherein the holder device is formed of a metal.

9. An arrangement according claim 8, wherein at least a substantial portion of the holder device is fabricated from aluminum.

10. An arrangement according to claim 7, comprising a medium that enhances thermal contact applied between the holder device and the cooling means.

11. An arrangement according to claim 10, wherein said medium comprises a hydrocarbon grease.

12. An arrangement according to claim 1, wherein the receptacle is attached to said holder device by an adhesive, said adhesive forming said electrically isolating layer.

13. An arrangement according to claim 12, wherein said electrically isolating layer is provided to a predetermined thickness.

14. An arrangement according to claim 1, wherein the receptacle is formed of a thermally conductive material.

15. An arrangement according to claim 14, wherein the thermally conductive material is selected from the group consisting of brass or copper.

* * * * *